US005328381A

United States Patent [19]

Seymour et al.

[11] Patent Number: 5,328,381

[45] Date of Patent: Jul. 12, 1994

[54] CONNECTOR MODULE HAVING SIX DEGREES OF FREEDOM

[75] Inventors: Douglas G. Seymour; Ronald E. Thomas, both of Warren; James C. Humphrey, Russell, all of Pa.

[73] Assignee: Osram Sylvania Inc., Danvers, Mass.

[21] Appl. No.: 700,977

[22] Filed: May 16, 1991

[51] Int. Cl.[5] ..... H01R 13/64

[52] U.S. Cl. ..... 439/247; 439/692

[58] Field of Search ..... 439/246-252, 439/259, 262, 359-364, 374, 376, 378, 380, 381, 692

[56] References Cited

U.S. PATENT DOCUMENTS

| | | | |
|---|---|---|---|
| 1,183,516 | 5/1916 | Anderson | 439/247 |
| 2,438,371 | 3/1948 | Marholz | 439/247 |
| 3,999,830 | 12/1976 | Herrmann, Jr. et al. | 439/362 |
| 4,075,444 | 2/1978 | Hollingsead et al. | 439/252 |
| 4,162,816 | 7/1979 | Malsot | 439/246 |
| 4,493,521 | 11/1985 | Simon | 439/359 |
| 4,684,192 | 8/1987 | Long et al. | 439/374 |
| 4,954,094 | 9/1990 | Humphrey | 439/247 |

*Primary Examiner*—David L. Pirlot
*Attorney, Agent, or Firm*—William H. McNeill

[57] ABSTRACT

The present invention features an electrical and electronic connector module having six degrees of freedom. The connector module is particularly useful in advanced electrical and electronic wiring systems, such as multiplexed wiring systems, wherein many electrical functions or signals share common wire pathways. The connector module comprises a male header containing a plurality of male connector elements. A plurality of female connector elements disposed in a receptacle assembly is designed to align and mate with respective ones of the male connector elements disposed in the male header. The header and receptacle align by means of a pair of header shoulder bolts that seat within apertures disposed on distal ends of the receptacle. The mating of the male-female connectors is assured by reason that the receptacle is allowed to float within a housing, which forms part of the receptacle assembly.

20 Claims, 6 Drawing Sheets

CONNECTOR MODULE HAVING SIX DEGREES OF FREEDOM

TECHNICAL FIELD

The invention relates to electronic and electrical wiring systems, and more particularly to a connector module that has the versatility to provide a multiplicity of connection functions in a complicated wiring system having a host of diverse and integrated electronic and electrical operations.

BACKGROUND ART

In the past few decades, automobiles have become increasingly more complex with the introduction of computer controls, anti-lock braking systems, electronic dashboards, etc. This sophistication has increased the demands upon the electrical and electronic wiring systems of these automobiles. Current automotive electrical-electronic systems comprise a diverse system of integrated and stand-alone components. It is contemplated that future automotive systems will integrate many diverse functions such as: torque-demand powertrain control; vehicle dynamics including braking, steering and suspension; electric power management including new power generating components; load management controls; traction control based on combined powertrain control and anti-lock braking; multi-purpose soft switching and shared displays featuring driver information; climate control and entertainment functions; and advanced collision avoidance and navigational systems.

All of the above electrical and electronic integration will require greater computing power and more robust and versatile electrical and electronic wiring and connections.

Connectors that would traditionally be useful in complex computer systems will not suffice in automotive environments where temperatures vary between −40 to 150 degrees Centigrade. Also, automotive connectors, unlike their computer connector counterparts, are subject to corrosion from automotive solvents such as anti-freeze, gasoline, brake fluid, battery acid, lubricants, etc.

At the same time that automotive systems are becoming more complex, the competition to obtain market share has forced manufacturers to extend the automobile warranty. Therefore, specifications of system connections are becoming increasingly more stringent. The specifications for connectors are rapidly approaching the criticality associated with space and aeronautical applications.

Electronic packaging in the advanced integrated systems will utilize multiplexing. This multiplexing will require that a variety of signals and a host of data pathways be shared over common wires. The multiplexed architecture will make integration not only more feasible, but more effective as well. By virtue of the newly introduced complexities, connector modules for such systems will be required to have greater versatility and be more robust. Therefore, it follows that the integrity and effectiveness of these advanced electronic and electrical automotive systems will be enormously dependent upon the success and design of the wiring connections and connector modules.

The present invention provides a new connector module designed to fulfill some of the aforesaid objectives for advanced automotive electrical and electronic systems.

The connector module of this invention comprises a sturdy unit that will provide blind mating of connector elements. Utilizing a novel floating receptacle design, the connector module of the current invention can accommodate misalignments in six degrees of movement (i.e., both in dimensional and rotational axes). The ability to function with misaligned mating parts along every axis of movement provides a connector module that will meet rigid specifications and tolerances for the new age of automotive electronics.

In U.S. Pat. No. 4,954,094, issued to Humphrey on Sep. 4, 1990, for "Sliding Gimbal Connector," a gimballed connector is illustrated for providing a looseness of fit in dimensional as well as rotational axes.

The current invention is designed with a floating receptacle that can be adjusted both dimensionally and rotationally with respect to a mating header connector member, wherein all the possible misalignments are obviated. In other words, the male and female mating elements of the connector module will always align in all six dimensional and rotational axes.

DISCLOSURE OF THE INVENTION

In accordance with the present invention, there is provided an electrical and electronic connector module having six degrees of freedom. The connector module is particularly useful in advanced electrical and electronic wiring systems, such as multiplexed wiring systems, wherein many electrical functions or signals share common wire pathways. The connector module comprises a male header containing a plurality of male connector elements. A plurality of female connector elements disposed in a receptacle assembly is designed to align and mate with respective ones of the male connector elements disposed in the male header. The header and receptacle align by means of a pair of header shoulder bolts that seat within apertures disposed on distal ends of the receptacle. The mating of the male/female connectors is assured by reason that the receptacle is allowed to float within a housing, which forms part of the receptacle assembly. The floating receptacle can move both dimensionally and rotationally with respect to the housing, and with the aligning shoulder bolts of the header, such that there is provided six degrees of moveable freedom when the male header is installed. The housing is designed as a split pair of housing halves that are affixedly joined together in an aligned position (i.e., when the male and female connector elements of the header and receptacle are in proper mating alignment).

Each housing half contains a slot for receiving a flange of the receptacle, for movement therein. Each slot of the housing half is characterized by a curved fulcrum section disposed in a midportion thereof. The curved fulcrum section allows the receptacle to pivot with respect to the housing. A secondary lock member disposed below the receptacle receives a foot portion of each female connector. The secondary lock member prevents the mating parts from dislodging from their set mating positions. The wires connecting to the female connector elements feed through the secondary lock member and the foot portion of each female connector. A dual crimping tab disposed on each female connector element provides attachment to the respective lead and insulation of each wire.

It is an object of this invention to provide a connector module having several degrees of freedom of alignment, so that rigorous tolerance specification can be accommodated by the module, without requiring the closeness of fit or tolerance of the aligning parts.

It is another object of the invention to provide an improved electrical and electronic connector module for use in multiplexed, automotive integrated systems.

BEST MODE FOR CARRYING OUT THE INVENTION

For a better understanding of the present invention, together with other and further objects, advantages and capabilities thereof, reference is made to the following disclosure and appended claims taken in conjunction with the above described drawings.

Figure 1A:
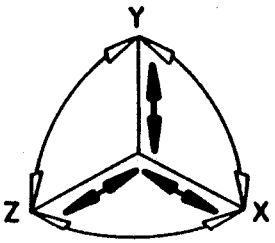
FIG. 1*a* depicts a schematic view of the six degrees of movement to which the receptacle can accommodate the mating header, shown in FIG. 1.
Figure 1:
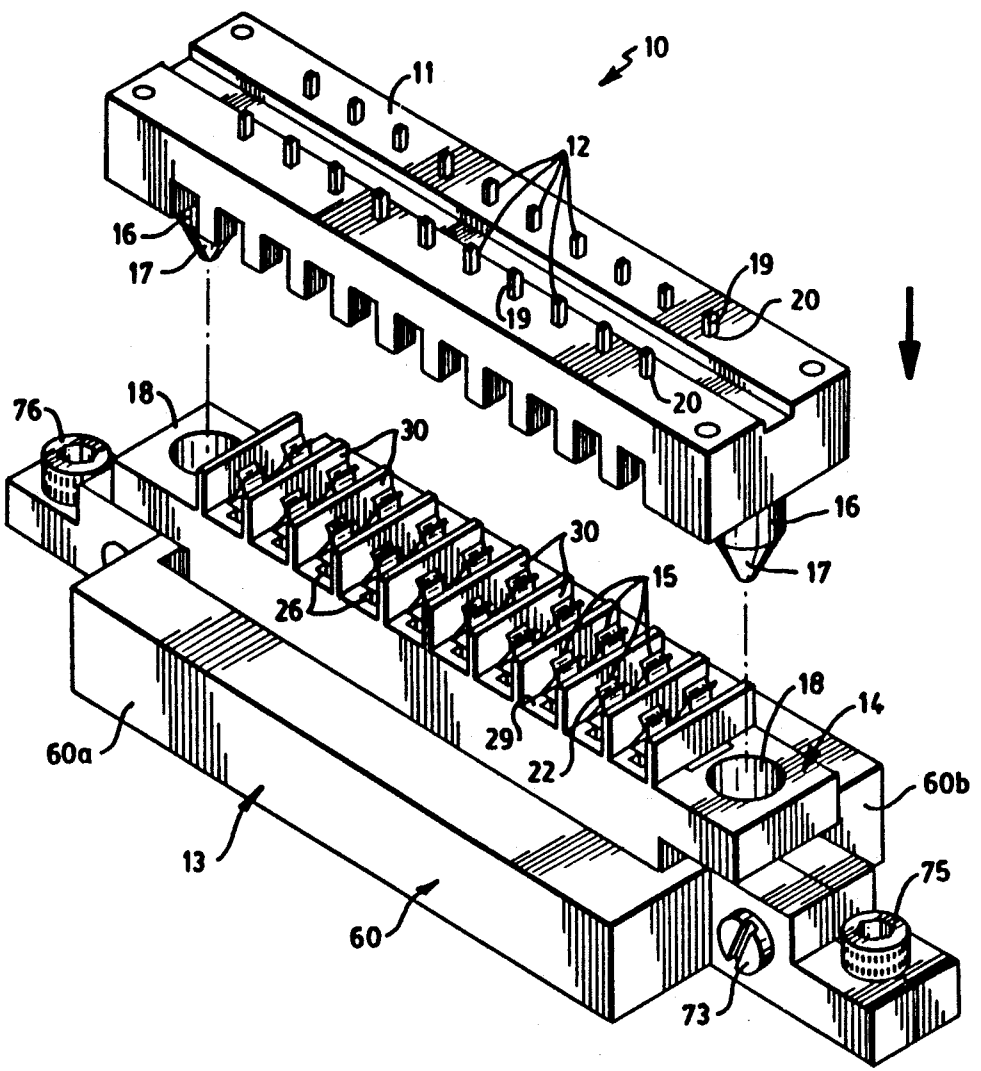
FIG. 1 is a perspective view of the connector module of this invention, illustrating the mating alignment of the header and receptacle assembly.

Referring now to the drawings with greater particularity, there is shown in FIG. 1 a connector module 10. The connector module 10 includes two mating subassemblies featuring a male header 11 containing two parallel rows of male connector blades 12, and a female receptacle assembly 13 containing a receptacle 14 containing two parallel rows of female connector sockets 15. The blades 12 are shown in greater detail with reference to FIGS. 3 and 2*a*, respectively. The female receptacle 14 and female connector sockets 15 are depicted in greater detail with reference to FIGS. 4 and 2*b*, respectively.

The male header 11 is directed into, and anchored within, the female receptacle 14 by means of two shoulder bolts 16, disposed on each end of the male header. Each of the shoulder bolts 16 has a conical, convex nose 17 that seats in a respective conical, concave aperture 18 disposed on distal ends of receptacle 14. The conical shape of the bolts 16 and apertures 18 allows for adjusted, pivotal seating of the male header 11 with respect to receptacle 14.

When the male header 11 and the female receptacle 14 connect with each other, each male blade 12 in the two parallel rows of the male header 11 seat and connect with a corresponding female socket 15 in the two respective parallel rows of the receptacle 14.

The male header 11 will always properly seat in the receptacle 14, despite the wide manufacturing tolerances provided for these parts. This is so because the male header 11 and female receptacle 14 have six degrees of freedom with respect to each other. That is, the receptacle 14 can move in all six dimensional and rotational directions with respect to the male header to provide exact seating. The six degrees of freedom are schematically shown in FIG. 1*a*, and will be further explained with reference to FIG. 5. The six degrees of movement provide exact fit despite wide manufacturing tolerances, which keeps costs low and also allows for a robust structure.

Figure 2A:
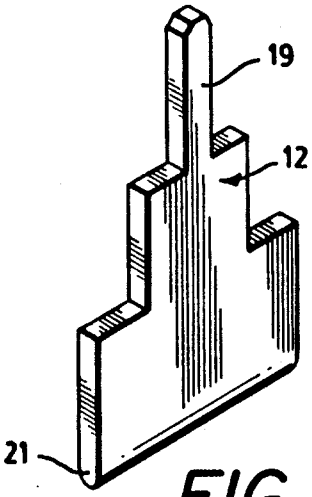
FIG. 2*a* is a perspective view of a typical male connector element that is disposed in the header of the connector module, illustrated in FIG. 1.
Figure 3:
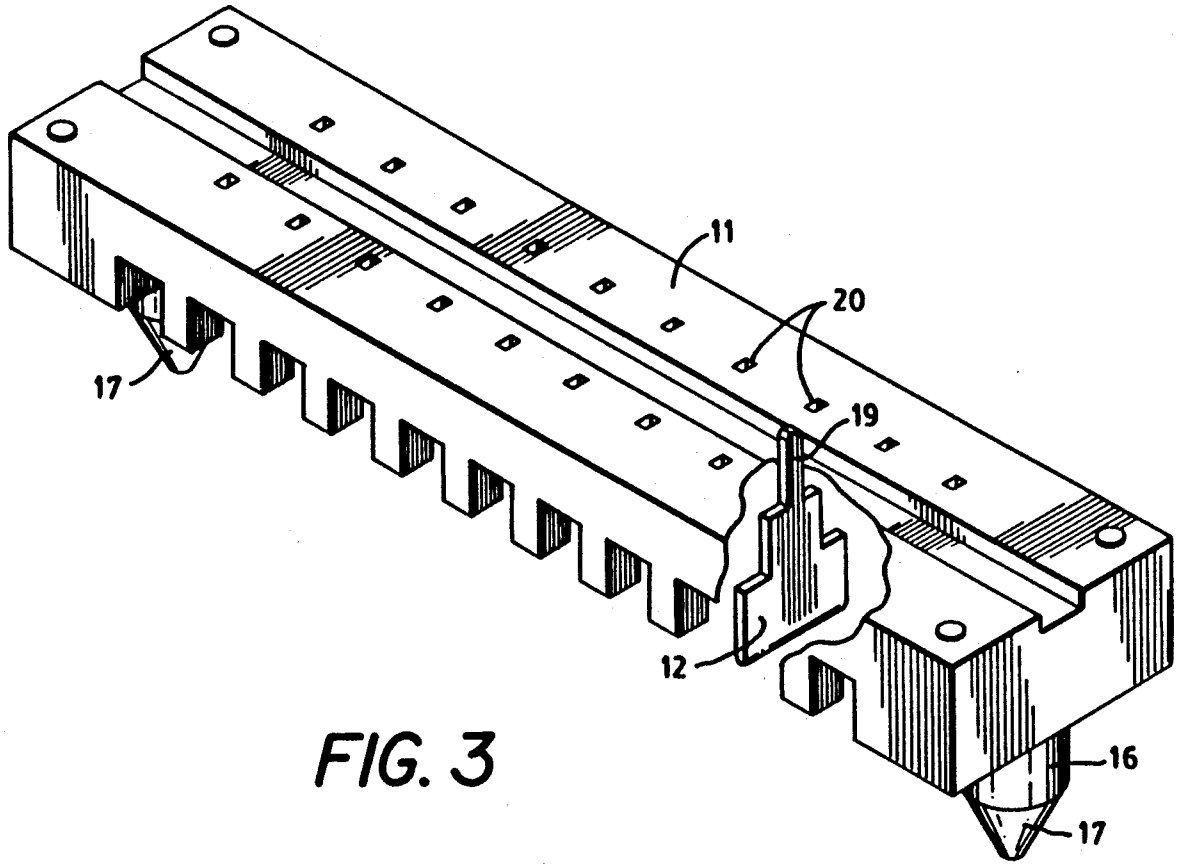
FIG. 3 is a partially cut-away, perspective view of the header of FIG. 1, with a typical male connector element disposed therein.
Figure 4:
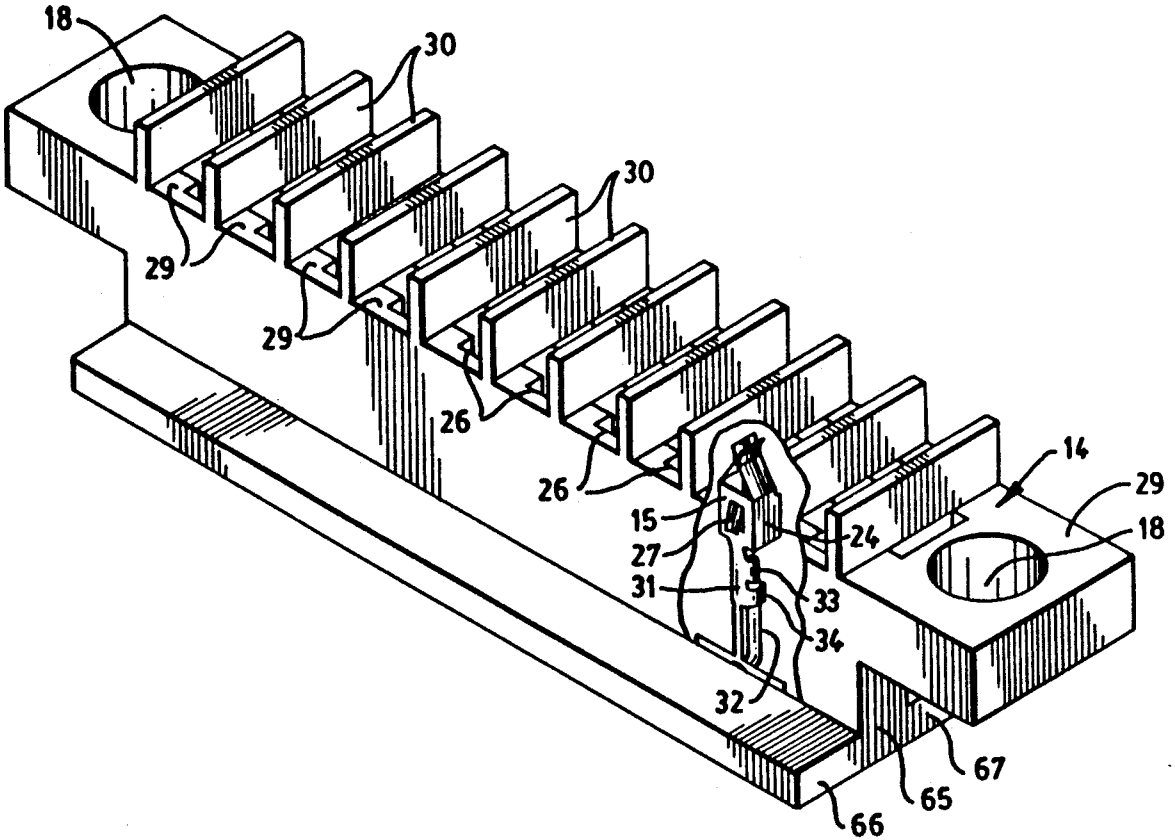
FIG. 4 is a partially cut-away, perspective view of the receptacle of FIG. 1, with a female connector element disposed therein.

A typical male blade 12 is shown in enlarged view in FIG. 2*a*, and its typical position within the male header 11 is depicted in FIG. 3. The male blade 12 has a beveled edge 21 for seating in the diverging jaws 22 of the socket prongs 25 of female socket 15, a typical female socket 15 being shown in FIG. 2*b*. Female socket 15 is shown in position within the receptacle 14 as illustrated in FIG. 4.

Each male blade 12 has a shaft 19 which projects through the hole 20 in one of the parallel rows of holes in male header 11, as depicted in FIGS. 1 and 3. Each female socket 15 has a body portion 24 that fits within a slot 26 of one of the parallel rows of the female receptacle 14, as shown in FIG. 4. The body portion 24 of each socket 15 is anchored into each slot 26 by means of two oppositely disposed, snap-acting tabs 27 disposed on each side of body portion 24 (one of the tabs 27 being shown in phantom).

When a female socket 15 is inserted upwardly into the slot 26, it is pushed into the slot until both tabs 27 compress and then release as their lower edge 28 clears upper surface 29 of female receptacle 14. When the tabs 27 expand past slot 26, they engage surface 29, preventing the downward removal of socket 15 from the receptacle 14. In other words, the tabs 27 anchor and affix the socket 15 in place with respect to the receptacle 14.

A plurality of partitions 30 extend from surface 29 of receptacle 14, and act to protect and isolate two male-female connections.

A wire connector (not shown) will attach to the shaft 19 of each male blade 12, so that a wire can extend from each male blade.

Figure 2B:
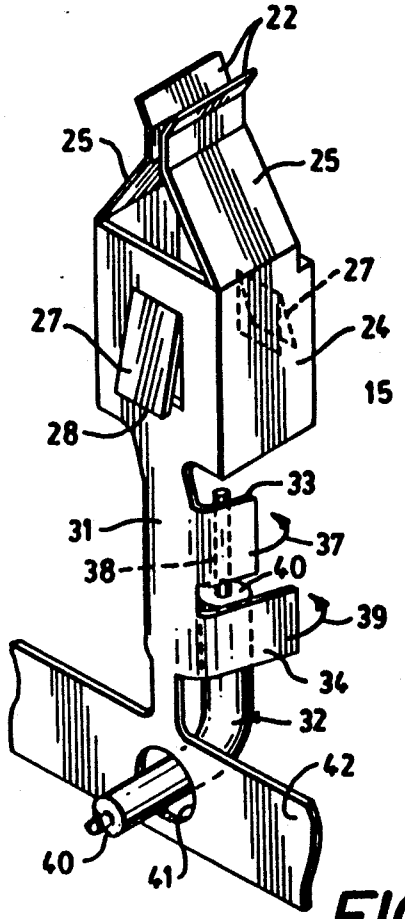
FIG. 2*b* is a perspective view of a typical female connector element that is disposed in the receptacle, shown in FIG. 1.
Figure 7:
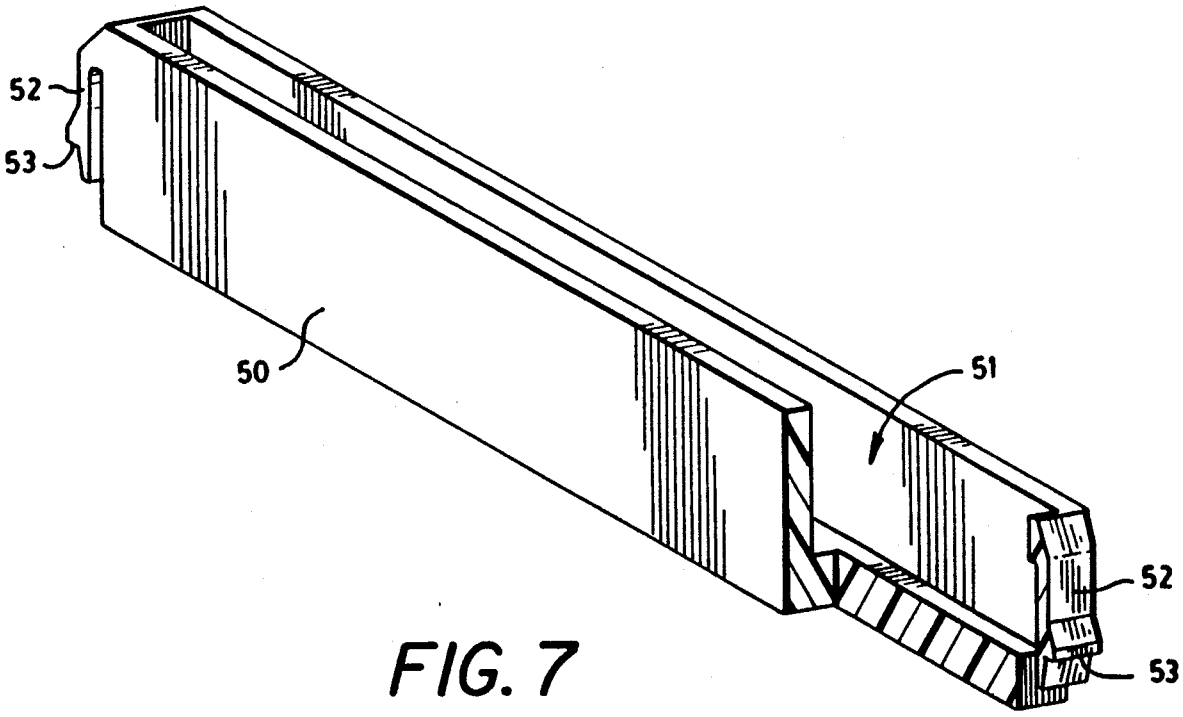
FIG. 7 is a partially cut-away, perspective view of a secondary lock member of the receptacle assembly, shown in FIG. 1.

A wire 32 attaches to each socket 15 by means of lead crimp tab 33 and insulation crimp tab 34 disposed on a shaft extension 31, as illustrated in FIGS. 2*b* and 4. Lead crimp tab 33 is crimped (arrow 37) around a stripped lead 38 of wire 32, while the insulation crimp tab 34 is crimped (arrow 39) around the insulation 40 of wire 32. The wire 32 extends from the socket 15 through aperture 41 in footing 42. The footing 42 is used to further anchor each socket 15 in place within the receptacle assembly 13, via a secondary lock member 50, shown in FIG. 7. The secondary lock member 50, which is also illustrated in the exploded view of FIG. 5, comprises a slot 51 for receiving all the footings 42 from each socket member 15.

The secondary lock member 50 fits within a slot (not shown), disposed underneath female receptacle 14. The secondary lock member 50 snaps into the underneath slot by means of two snap-acting tabs 52 disposed on distal ends of the secondary lock member 50. An edge extension 53 on each tab 52 snaps over an abutment (not shown) in the underneath slot, thus anchoring and affixing the secondary lock member to the receptacle 14.

Figure 5:
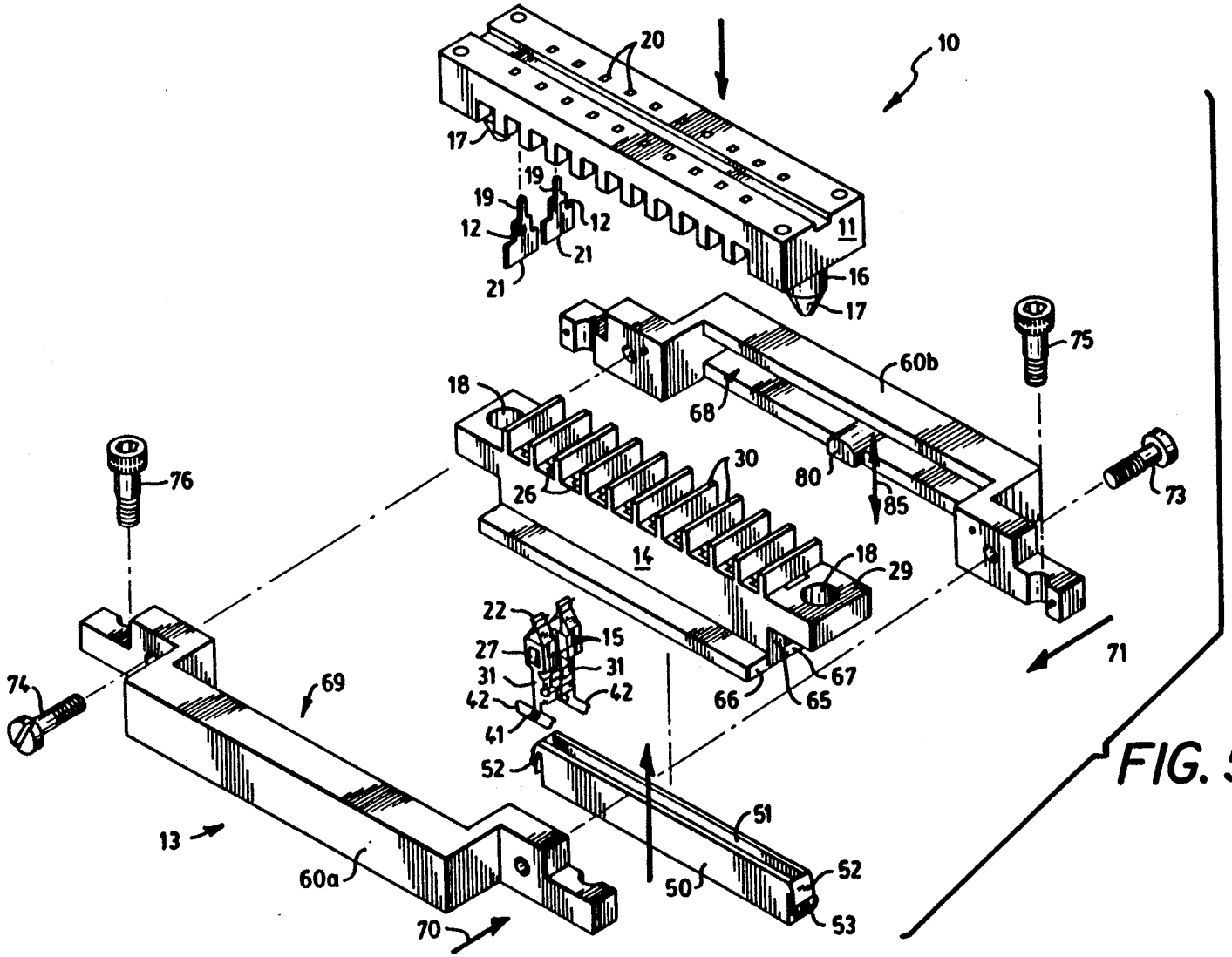
FIG. 5 is an exploded, perspective view of the connector module, depicted in FIG. 1.
Figure 6:
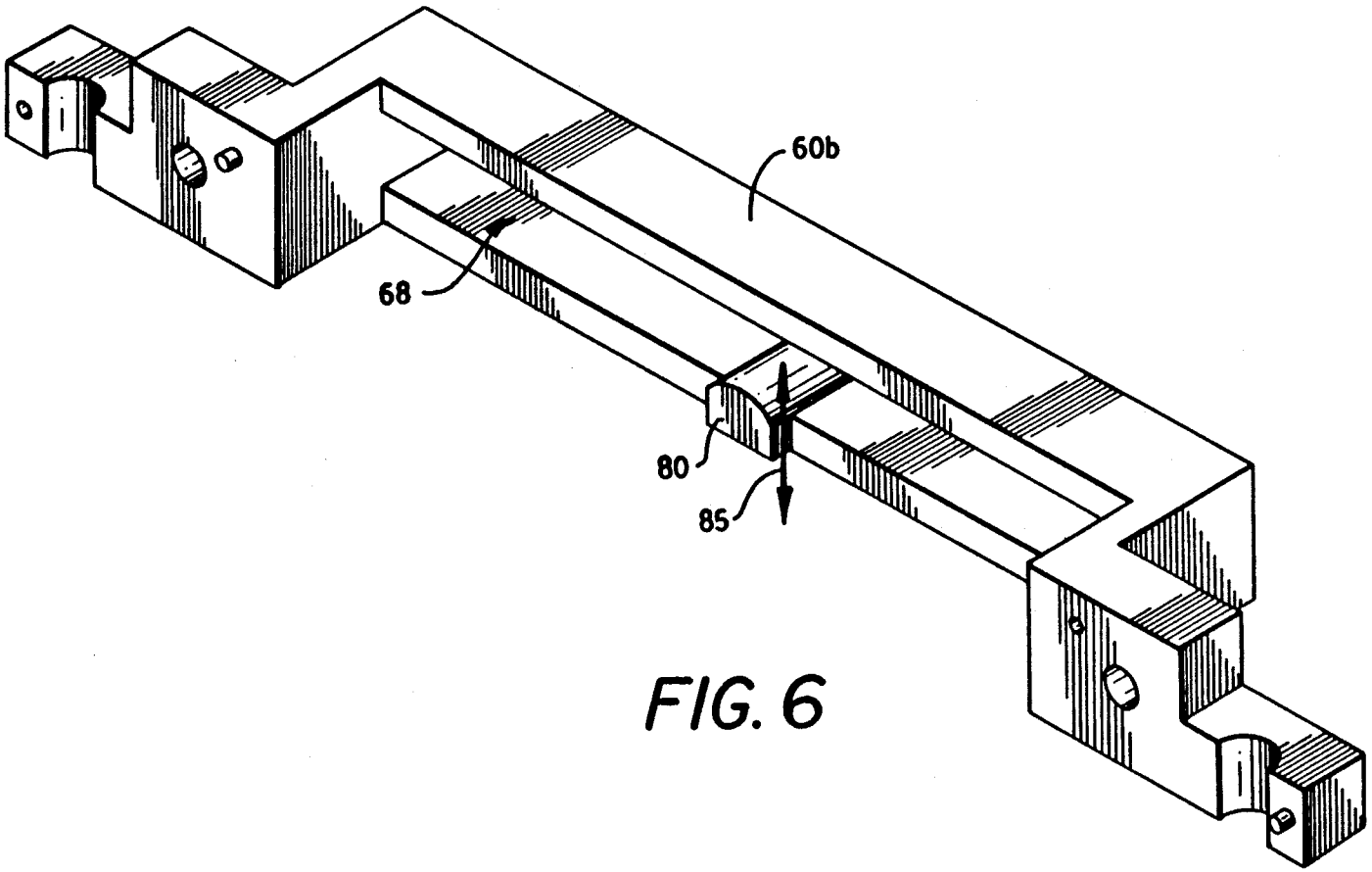
FIG. 6 is an enlarged, perspective view of one of the float housing half sections of the receptacle assembly, illustrated in FIG. 1.

The entire assembly of connector module 10 is shown in the exploded view of FIG. 5. This view will also be used to explain how the six degrees of freedom are obtained between the male header 11 and the female receptacle. It should be observed that the receptacle assembly 13 also includes two halves 60*a* and 60*b* of a floating housing 60. The floating housing half 60*b* is also shown in FIG. 6 in an enlarged view.

The assembled floating housing 60, shown in FIG. 1, is used to lock the female receptacle 14 in a given position with respect to male header 11, in order to obtain the correct mating between the male blades 12 and the corresponding female sockets 15.

The female receptacle is illustrated with a lower extension post 65 (FIGS. 4 and 5). The lower extension post 65 has two flange sections 66 and 67 projecting therefrom in opposite directions. Flange section 67 is received within the slot 68 of floating housing half 60*b*, while flange section 66 is received in a slot 69 (not visible) in floating housing half 60*a*. When the two halves 60*a* and 60*b* are brought together (arrows 70 and 71) and clamped by means of set screws 73 and 74, the housing 60 locks about the flange sections 66 and 67 to affix the receptacle 14 in a given position.

The receptacle 14 is free to adjust its position within the floating housing 60 until the set screws 73 and 74 are tightened. The flange sections 66 and 67 allow the receptacle to move along the dimensional X and Z axes (FIG. 1*a*) within respective slots 68 and 69 of the floating housing halves 60*b* and 60*a*.

The receptacle 14 is free to adjust itself in the Y axis direction (FIG. 1*a*) by means of the conical shoulder bolts 16 and conical apertures 18.

The rotational adjustment of receptacle 14 between Y and X (FIG. 1*a*) is achieved by means of a curved fulcrum wedge 80 (FIGS. 5 and 6) disposed in a midportion of each of the slots 68 and 69. Wedge 80 is adjustable (arrow 85) in the Y axis, so that the receptacle is rotationally adjustable between Y and Z. This adjustment is also accommodated by the seating of the shoulder bolts 16 in respective apertures 18.

The rotational adjustment of the receptacle with respect to the male header 11 between Z and X is accommodated by means of the conical shoulder bolts as they seat in the conical apertures 18.

The set screws 75 and 76 are used to further secure floating housing halves 60*a* and 60*b* together.

It will be observed that the ability to vary the dimensional and rotational movement of the receptacle 14 with respect to the header 11 provides a receptacle that can be used in automotive wiring systems throughout the automobile. The connections are buried within the header and receptacle, thus protecting them from corrosive materials and substances.

The radial tolerances of this connector module 10 are about 3 mm. Arc travel of mating parts is about 2 degrees. Male blades and sockets can be made of tin-lead plated nickel and CDA 260 brass. The header and receptacle sub-assemblies can be fabricated from polyphenylene or other corrosion resistant plastics. The rigid, low tolerance connection system of this connector module provides a robust, low cost apparatus most suitable for advanced automotive multiplexed signal and power wiring systems.

While there have been shown and described what are considered to be the preferred embodiments of the invention, it will be apparent to those skilled in the art that various changes and modifications can be made herein without departing from the scope of the invention as defined by the appended claims.

What is claimed is:

1. A connector module for connecting electrical and electronic wiring, comprising:

a male header having at least one male connection element; and a female receptacle assembly having at least one female connection element for mating with the male connection element of said male header to provide a wiring connection, said female receptacle assembly joining with said male header to provide said mating of male and female connection elements, said female receptacle assembly further including:

a) a receptacle member;

b) a floating housing disposed about, and receiving said receptacle member therein, said receptacle member movable within said floating housing in dimensional and rotational axes in order to adjust its position with respect to said male header, whereby said male header will adjustably join with said female receptacle assembly; and c) locking means supported by said floating housing for locking an adjusted receptacle member position within said floating housing.

2. The connector of claim 1 wherein said floating housing further comprises two half sections that join together.

3. The connector module of claim 1 further comprising a secondary lock member disposed within and supported by said receptacle member for locking said at least one female connection element within said receptacle member.

4. The connector module of claim 1 wherein said male header further comprises two shoulder bolts disposed on distal ends thereof, and further wherein each of said shoulder bolts adjustably seat within respective apertures.

5. The connector module of claim 1 wherein male header comprises a plurality of male connection elements that mate with a plurality of female connection elements disposed in said female receptacle assembly.

6. The connector module of claim 5 wherein each of said plurality of male connection elements and each of said plurality of female connection elements are disposed in a least one row adjacent one another to provide mating therebetween.

7. The connector module of claim 5 wherein said plurality of male connection elements and said plurality of female connection elements are each disposed in two parallel rows adjacent one another to provide mating therebetween.

8. The connector module of claim 1 wherein said male header comprises a plurality of male connection elements and wherein said female receptacle assembly comprises a plurality of female connection elements, and further wherein said male connection elements each include a connector blade, and each of said female connection elements comprises sockets.

9. The connector module of claim 8 wherein said plurality of male connection elements and said plurality of female connection elements are each disposed in two parallel rows adjacent one another to provide mating therebetween.

10. A connector module for connecting electrical and electronic wiring, comprising:

a male header having at least one male connection element and a pair of shoulder bolts for adjustable seating within a corresponding pair of apertures; and a female receptacle assembly having at least one female connection element for mating with the male connection element of said male header to provide a wiring connection and means defining a pair of apertures for receiving said pair of shoulder bolts, said female receptacle assembly joining with said male header to provide said mating of male and female connection elements, said female receptacle assembly further including:

a) a receptacle member;

b) a floating housing disposed about, and receiving said receptacle member therein, said receptacle member movable within said floating housing in dimensional and rotational axes in order to adjust its position with respect to said male header, whereby said male header will adjustably join with said female receptacle assembly; and c) locking means supported by said floating housing for locking an adjusted receptacle member position within said floating housing.

11. The connector module of claim 10 wherein said floating housing further comprises two half sections that join together.

12. The connector module of claim 10 further comprising a secondary lock member disposed within and supported by said receptacle member for locking said at least one female connection element within said receptacle member.

13. The connector module of claim 10 wherein said male header further has said pair of shoulder bolts disposed on distal ends thereof, and wherein said receptacle member has said pair of apertures disposed on distal ends thereof, and further wherein each of said shoulder bolts adjustably seat within respective ones of said pair of apertures.

14. The connector module of claim 10 wherein said male header comprises a plurality of male connection elements that mate with a plurality of female connection elements disposed in said female receptacle assembly.

15. The connector module of claim 14, wherein said plurality of male connection elements and said plurality of female connection elements are each disposed in at least one row adjacent one another to provide mating therebetween.

16. The connector module of claim 14, wherein said plurality of male connection elements and said plurality of female connection elements are each disposed in two parallel rows adjacent one another to provide mating therebetween.

17. The connector module of claim 10, wherein said male header comprises a plurality of male connection elements and wherein said female receptacle assembly comprises a plurality of female connection elements and wherein said male connection elements each include a connector blade, and further wherein each of said female connection elements comprises sockets.

18. The connector module of claim 17, wherein said plurality of male connection elements and said plurality of female connection elements are each disposed in two parallel rows adjacent one another to provide mating therebetween.

19. A connector module for connecting electrical and electronic wiring, comprising:

a male header having at least one male connection element and a pair of shoulder bolts for adjustable seating within a corresponding pair of apertures; and a female receptacle assembly having at least one female connection element for mating with the male connection element of said male header to provide a wiring connection and means defining a pair of apertures for receiving said pair of shoulder bolts, said female receptacle assembly joining with said male header to provide said mating of male and female connection elements, said female receptacle assembly further including:

a) a receptacle member;

b) a floating housing disposed about, and receiving said receptacle member therein, said receptacle member movable within said floating housing in dimensional and rotational axes in order to adjust its position with respect to said male header, whereby said male header will adjustably join with said female receptacle assembly; and c) a secondary locking member supported by said female receptacle assembly for locking said female connection element within said female receptacle assembly.

20. The connector module of claim 19, wherein said floating housing further comprises two half sections that join together.

* * * * *